US006131306A

United States Patent [19]

Retulainen

[11] Patent Number: 6,131,306

[45] Date of Patent: Oct. 17, 2000

[54] METHOD AND APPARATUS FOR DRYING A FIBER WEB

[75] Inventor: Elias Retulainen, Kulju, Finland

[73] Assignee: Valmet Corporation, Helsinki, Finland

[21] Appl. No.: 09/399,700

[22] Filed: Sep. 21, 1999

Related U.S. Application Data

[63] Continuation of application No. PCT/FI98/00240, Mar. 19, 1998.

[30] Foreign Application Priority Data

Mar. 21, 1997 [FI] Finland ..... 971210

[51] Int. Cl.[7] ..... F26B 7/00

[52] U.S. Cl. ..... 34/421; 34/461; 34/508; 34/71; 34/95; 34/116; 162/197; 162/358.5

[58] Field of Search ..... 34/355, 421, 461, 34/508, 71, 95, 116, 117, 119, 120, 124, 130, 613, 619; 162/206, 207, 375, 358.3, 358.5, 197

[56] References Cited

U.S. PATENT DOCUMENTS 4,461,095 7/1984 Lehtinen .
5,762,759 6/1998 Wedel ..... 162/193
5,983,523 11/1999 Ijas et al. ..... 34/445
6,001,421 12/1999 Ahonen et al. ..... 427/316
6,009,634 1/2000 Retulainen ..... 34/71

FOREIGN PATENT DOCUMENTS

WO 96/11300 4/1996 WIPO .

OTHER PUBLICATIONS

PCT International Search Report, PCT/FI98/00240, Completed Jun, 15, 1998.

*Primary Examiner*—Pamela A. Wilson
*Attorney, Agent, or Firm*—Alston & Bird LLP

[57] ABSTRACT

An apparatus for drying and smoothing a fibre web between two tight bands that move in parallel and run around turning rolls, the first band being heated with hot steam and the second band being cooled with water, and the fibre web being conducted through the drying zone that the bands define together with at least one felt or wire such that the fibre web is in contact with the surface of the first, heated band and that the felt or wire is between the fibre web and the second, cooled band. The apparatus and method further comprise spreading the fibre web in its transverse direction before it is led into the drying apparatus.

12 Claims, 1 Drawing Sheet

METHOD AND APPARATUS FOR DRYING A FIBER WEB

CROSS-REFERENCE TO RELATED APPLICATIONS

Figure 1:
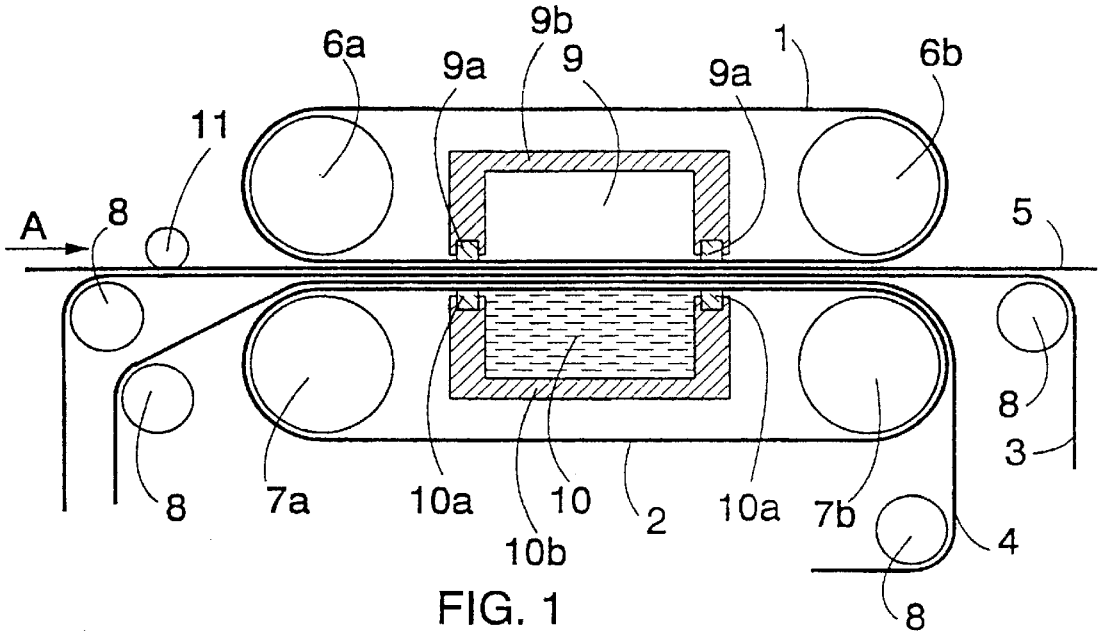

This application is a continuation of pending PCT International Application PCT/FI98/00240, filed Mar. 19, 1998, designating inter alia the United States.

The invention relates to a method for drying a fiber web, in which method the fiber web is dried with a drying apparatus comprising two endless air-impermeable bands, first turning rolls, the first band being arranged to turn around the first turning rolls, and second turning rolls, the second band being arranged to turn around the second turning rolls, whereby the first band and the second band are arranged to run part of the way parallel with each other in such a way that they form a drying zone between them, the first band being heated and the second band being cooled, and whereby the fiber web and at least one felt or wire are led between the bands in such a way that the fiber web is in contact with the heated first band and the felt or wire, respectively, is between the fiber web and the cooled second band.

The invention relates further to an arrangement for drying a fiber web, which arrangement comprises a drying apparatus comprising two endless air-impermeable bands, first turning rolls, the first band being arranged to turn around the first turning rolls, and second turning rolls, the second band being arranged to turn around the second turning rolls, whereby the first band and the second band are arranged to run part of the way parallel with each other in such a way that they form a drying zone between them, the first band being heated by heating means and the second band being cooled by cooling means, and whereby the fiber web and at least one felt or wire are led between the bands in such a way that the fiber web is in contact with the heated first band and the felt or wire, respectively, is between the fiber web and the cooled second band.

Drying a fiber web between two parallel metal bands moving in the same direction in such a way that the fiber web is in contact with the heated metal band and there is a wire between the fiber web and the second cooled metal band, so that the steam separated from the fiber web on account of heating condenses to the wire by the effect of the cold metal band, is known from several patent publications, of which can be mentioned e.g. Finnish Patent Application 944 775 and U.S. Pat. No. 4,461,095. The operation is based on that two endless metal bands are arranged to run around turning rolls and that pressure chambers containing hot steam and water, respectively, are provided against the inside surface of the loops formed by the bands so that the pressure produced presses the hot and the cold band, and respectively, the fiber web and the wire between them towards each other. The bands located between the pressure chambers constitute by means of seals one side of the pressure chambers so that the steam and water can affect the bands directly. The operation of the apparatus is fully known per se and disclosed e.g. in the above patent applications, which are incorporated herein by reference.

In a conventional drying apparatus, where a fiber web is dried by means of several drying cylinders, the fiber web shrinks quite much in the transverse direction, which again weakens the transverse properties of the fiber web, such as compression resistance of a product to be manufactured. Further in a conventional drying apparatus, the fiber web is subjected to a machine direction tension, which is necessary for transporting the web. On account of Poisson effect, this machine direction tension tends to make the web narrower still, which weakens the transverse properties of the web additionally. In the drying apparatus described in the foregoing paragraph, where the fiber web is dried between two parallel metal bands moving in the same direction, it is possible to prevent the fiber web from shrinking during drying completely, both in the machine and transverse direction. The structure of the fiber web can then be fixed to remain such as it was when entering the drying apparatus. In connection with some products, however, the transverse properties should be better still. As regards packing boards, in particular, where the transverse direction usually is the vertical direction of a board package as well, the transverse properties of the fiber web shall also be very good. Especially when packages are piled on each other, the vertical compression strength of the packages will be critical.

The object of the present invention is to provide a method and an arrangement, which can be utilized for improving the transverse properties of a fiber web.

The method of the invention is characterized in that the fiber web is spread in its transverse direction before it is led into the drying apparatus.

Further, the arrangement of the invention is characterized in that the arrangement comprises means for spreading the fiber web in its transverse direction before it is led into the drying apparatus.

The essential idea of the invention is that a fiber web is spread in its transverse direction before it is led into a drying apparatus. Moreover, it is essential that, after spreading, the fiber web is dried between two parallel bands moving in the same direction in such a way that the fiber web is in contact with the heated band and there is a wire between the fiber web and the second cooled band, so that the steam separated from the fiber web on account of heating condenses to the wire by the effect of the cold band. Further, the idea of a preferred embodiment is that the fiber web is spread by means of at least one spreader roll. The idea of still another preferred embodiment is that, while the fiber web is spread, the side of the fiber web which is opposite to the spreader means is not supported or as a support is used a veil-like wire elastic in the transverse direction.

An advantage of the invention is that by spreading the fiber web in the transverse direction before leading it into the drying apparatus, it is possible to improve the coefficient of elasticity, the tensile strength and the compression resistance of the fiber web in the transverse direction. Further, by using a heated and a cooled band moving in the same direction for drying after the spreading, it is possible to fix the structure provided by a spreader means to remain in the fiber web. By leaving that side of the fiber web which is opposite to the spreader means without support at the spreader means or by supporting the fiber web with a veil-like wire stretching in the transverse direction, it is possible to spread the fiber web efficiently and easily.

The invention is described in greater detail in the attached drawings, where

Figure 2:
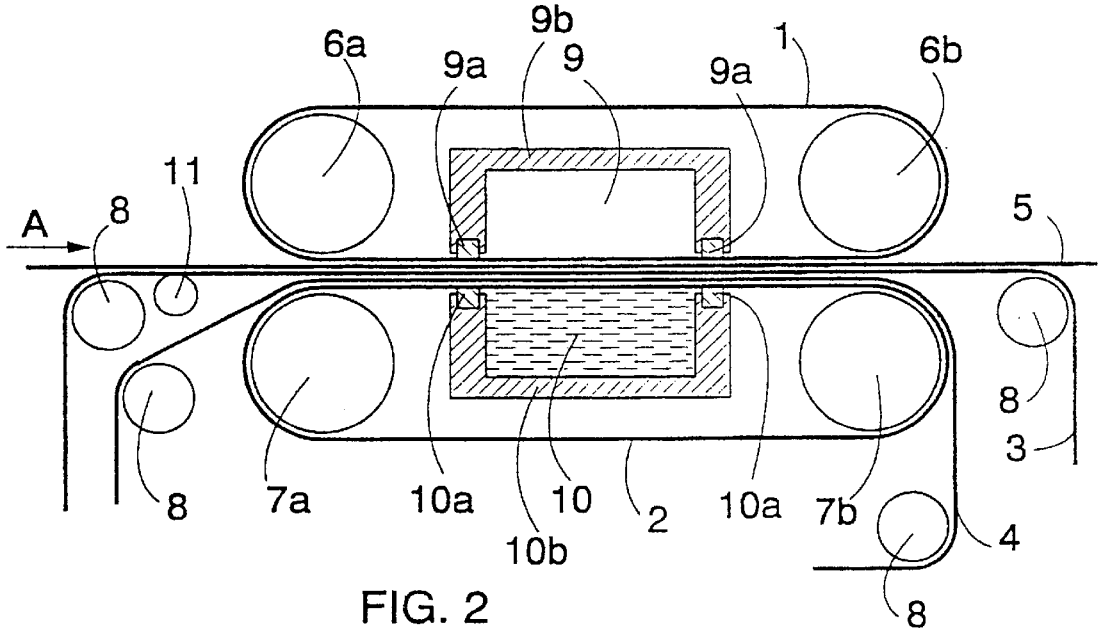
Figure 3:
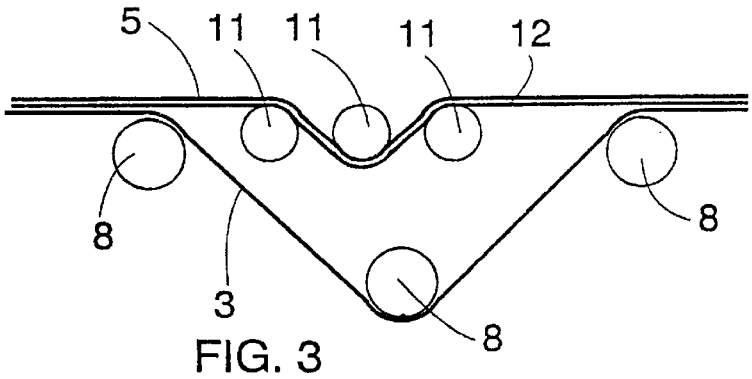

FIG. 1 shows schematically a sectional side view taken in the travel direction of the web, illustrating an arrangement according to the invention, FIG. 2 shows schematically a sectional side view taken in the travel direction of the web, illustrating a second arrangement according to the invention, and FIG. 3 shows schematically a detail of a third arrangement according to the invention at spreader rolls.

FIG. 1 is a schematic sectional side view taken in the travel direction of the a web, illustrating an arrangement according to the invention. The arrangement comprises a drying apparatus comprising endless air-impermeable bands that conduct heat well and are preferably made of metal: viz. a first band 1, i.e. the upper band, and a second band 2, i.e. the lower band, a fine wire or felt 3, a coarse wire 4 and fiber web 5 running between those surfaces of the bands that face each other. The fiber web 5 moves in the direction indicated by arrow A. The first band 1 is arranged to turn around first turning rolls 6*a* and 6*b* located at the ends of the drying apparatus. Correspondingly, the second band 2 is arranged to turn around second turning rolls 7*a* and 7*b* also located at the ends of the drying apparatus, below the first turning rolls 6*a* and 6*b*. The wires 3 and 4 are supported and guided by means of guide rolls 8. Since the pressure prevailing in the drying zone in the space between the bands 1 and 2 is usually different from the pressure prevailing outside or on the sides of the bands 1 and 2, seals are provided on both sides of the apparatus between or at the edges of the bands 1 and 2, the seals preventing liquid or gas from moving out of the space between the bands 1 and 2 sidewards, or vice versa. To effect vapor heating required by the drying, the drying apparatus comprises a pressure chamber 9, which is located above the first band 1. The first band 1 is sealed with seals 9*a* to the body 9*b* of the pressure chamber so that the steam in the pressure chamber 9 is maintained at a suitable pressure. Below the second band 2, there is a water chamber 10 containing water that cools the second band 2. At the edges of the water chamber 10, there are seals 10*a*, with which the second band 2 is sealed to the body 10*b* of the water chamber 10.

The operation of the drying apparatus is based on heating the first band 1 being in contact with the web 5 by hot steam contained in the pressure chamber 9. On account of the temperature of the first web 1, the water in the web 5 is then vaporized and transferred through the wires 3 and 4 toward the second band 2. The second band, in turn, is continuously cooled with water located below it, whereby the steam produced on the surface thereof condenses into water and is removed with the band 2 and the wire 4.

The arrangement comprises further a spreader roll 11, by which the fiber web 5 is spread in its transverse direction before it is led into the drying apparatus. In connection with this application, the term 'transverse' signifies a direction of the fiber web 5 essentially vertical to the machine direction. The spreader roll 11 is a rotating curved roll, by which the fiber web 5 can be spread in its transverse direction. In addition to the spreader roll 11, the spreading means may be a curved slide rod or mechanical spreading means at the edge of the fiber web 5 or some other spreading means known per se, for instance. The spreading means is preferably positioned as close to the drying apparatus as possible, whereby the transverse stretching of the fiber web 5 can be preserved as efficiently as possible. By using the drying apparatus of FIG. 1, it is possible to fix a desired transverse tension and a suitable stretched structure to remain in the fiber web 5. The spreading of the fiber web 5 is preferably subjected to a fiber web having a lowest possible dry matter content, because spreading a fiber web that is too dry may cause tearing of the fiber web 5.

FIG. 2 shows a schematic sectional side view taken in the travel direction of the web, illustrating a second arrangement according to the invention. The arrangement of FIG. 2 corresponds to the arrangement of FIG. 1, except that the arrangement of FIG. 2 comprises a spreader roll 11 arranged below the wire 3.

FIG. 3 shows a side view of a detail of a third arrangement according to the invention at spreader rolls 11. Reference numerals of FIG. 3 correspond to those of the FIGS. 1 and 2. By means of guiding rolls 8, the wire 3 is led away from supporting the fiber web 5 at the spreader rolls 11. The fiber web 5 can then be spread very easily and efficiently. On the other hand, such an unsupported section may be inconvenient in some cases, and therefore, a veil-like auxiliary wire 12 elastic in the transverse direction, but essentially inextensible in the machine direction, may be arranged for supporting the fiber web 5. Using such an auxiliary wire 12 also facilitates the spreading, but the auxiliary wire 12 simultaneously supports the fiber web 5 in the machine direction. Naturally, the wire 3 may also be a veil-like wire, elastic in the transverse direction, but essentially inextensible in the machine direction, in which case it is not necessary to lead the wire away from supporting the fiber web at the spreader rolls 11 like in FIG. 3.

More spreading force may be required of the spreading means for a fiber web 5 of thicker paper and board qualities, in particular. Accordingly, FIG. 3 shows that three spreader rolls 11 are used as spreading means. If desired, the number of the spreader rolls 11 may be even higher. In case of FIG. 3, the spreader rolls 11 are arranged at the same level in the height direction, whereby enfolding the fiber web 5 and the auxiliary wire 12 around each spreader roll 11 can be made relatively long. It is preferable to provide at least one spreader roll 11 with adjustable height level. In case of FIG. 3, the height level of the midmost spreader roll 11 is preferably adjustable. By adjusting the height level of said spreader roll 11, it is possible to adjust the enfolding of the web 5 and the auxiliary wire 12 around the spreader rolls 11. When the process of threading the fiber web 5 is started, the midmost spreader roll 11 may be lifted above the normal upper edge of the fiber web 5, which makes the threading of the fiber web 5 easy.

The drawings and the description relating to them are only intended to illustrate the idea of the invention. As to the details, the invention may vary within the scope of the claims. So, it is not essential which pressure medium is used in the pressure chamber 9 and the water chamber 10. The medium of the pressure chamber 9 may thus be steam, air or hot combustion gases of fuel, or, for instance, water. In addition to water, e.g. air can also be used as pressure medium in the water chamber 10.

In addition to the heating caused by the pressure chamber 9, the first band 1 can also be heated at other places in manners fully known per se. Further, heating the first band 1 may take place also entirely outside the pressure chamber 9 or drying the fiber web 5 may take place even without a pressure chamber 9.

Moreover, the second band 2 can be cooled also outside the water chamber 10 or the cooling can even be performed without a water chamber 10 in manners fully known per se.

What is claimed is:

1. A method for drying a fiber web, in which method the fiber web is dried with a drying apparatus comprising two endless air-impermeable bands, first turning rolls, the first band being arranged to turn around the first turning rolls, and second turning rolls, the second band being arranged to turn around the second turning rolls, whereby the first band and the second band are arranged to run part of the way parallel with each other in such a way that they form a drying zone between them, the first band being heated and the second band being cooled, and whereby the fiber web and at least one felt or wire are led between the bands in such a way that the fiber web is in contact with the heated first band and the felt or wire, respectively, is between the fiber web and the cooled second band, wherein the fiber web is spread in its transverse direction before it is led into the drying apparatus.

2. A method according to claim 1, wherein during spreading, the fiber web is essentially unsupported by the wires.

3. A method according to claim 1, wherein during spreading, the fiber web is supported in the transverse direction by an elastic wire.

4. A method according to claim 1, wherein the first band is heated by means of a pressure chamber and the second band is cooled by means of a chamber containing pressurized medium.

5. An arrangement for drying a fiber web, which arrangement comprises a drying apparatus comprising two endless air-impermeable bands, first turning rolls, the first band being arranged to turn around the first turning rolls, and second turning rolls, the second band being arranged to turn around the second turning rolls, whereby the first band and the second band are arranged to run part of the way parallel with each other in such a way that they form a drying zone between them, the first band being heated by heating means and the second band being cooled by cooling means, and whereby the fiber web and at least one felt or wire are led between the bands in such a way that the fiber web is in contact with the heated first band and the felt or wire, respectively, is between the fiber web and the cooled second band, wherein the arrangement comprises means for spreading the fiber web in its transverse direction before it is led into the drying apparatus.

6. An arrangement according to claim 5, wherein the means for spreading the fiber web comprise at least one spreader roll.

7. An arrangement according to claim 6, wherein the means for spreading the fiber web comprise at least two spreader rolls.

8. An arrangement according to claim 6, wherein the height level of at least one spreader roll is adjustable.

9. An arrangement according to claim 5, wherein the wires are arranged by means of guide rolls in such a way that, at the spreading means, the fiber web is essentially unsupported by the wires.

10. An arrangement according to claim 5, wherein a wire elastic in the transverse direction is arranged to support the fiber web at the spreading means.

11. An arrangement according to claim 10, wherein the wire elastic in the transverse direction is an auxiliary wire.

12. An arrangement according to claim 5, wherein the drying apparatus comprises a pressure chamber arranged to heat the first band and a chamber containing a pressurized medium and arranged to cool the second band.

* * * * *